US006196322B1

(12) United States Patent
Magnussen

(10) Patent No.: US 6,196,322 B1
(45) Date of Patent: Mar. 6, 2001

(54) UNDERWATER INSTALLATION AND METHOD FOR BUILDING OF AN UNDERWATER INSTALLATION

(76) Inventor: Terje Magnussen, Oksevollveien 24, N-4500 Mandal (NO)

( * ) Notice: Subject to any disclaimer, the term of this patent is extended or adjusted under 35 U.S.C. 154(b) by 0 days.

(21) Appl. No.: 09/142,547

(22) PCT Filed: Mar. 7, 1997

(86) PCT No.: PCT/NO97/00068

§ 371 Date: Sep. 10, 1998

§ 102(e) Date: Sep. 10, 1998

(87) PCT Pub. No.: WO97/34074

PCT Pub. Date: Sep. 18, 1997

(30) Foreign Application Priority Data

Mar. 12, 1996 (NO) ..... 960997

(51) Int. Cl.[7] ..... E21B 7/128; E21B 7/132; E21B 43/01

(52) U.S. Cl. ..... 166/350; 166/366; 166/367; 405/224.4

(58) Field of Search ..... 405/195.1, 203–208, 405/224, 224.2–224.4; 166/350, 366, 367

(56) References Cited

U.S. PATENT DOCUMENTS

| | | | | |
|---|---|---|---|---|
| 3,638,720 | | 2/1972 | Thomas | 166/350 |
| 3,911,688 | * | 10/1975 | Behar et al. | 166/350 X |
| 4,702,321 | * | 10/1987 | Horton | 166/350 |
| 4,762,180 | | 8/1988 | Wybro et al. | 166/350 |
| 4,913,238 | * | 4/1990 | Danazcko et al. | 166/350 |
| 5,439,321 | * | 8/1995 | Hunter | 166/350 X |
| 5,697,447 | * | 12/1997 | Börseth | 405/224.3 X |

FOREIGN PATENT DOCUMENTS

| | | |
|---|---|---|
| 150791 | 9/1984 | (NO) . |
| 165608 | 11/1990 | (NO) . |

* cited by examiner

*Primary Examiner*—David Bagnell
*Assistant Examiner*—Tara L. Mayo
(74) *Attorney, Agent, or Firm*—Andrus, Sceales, Starke & Sawall, LLP

(57) ABSTRACT

An underwater installation for use in offshore drilling of and production from, respectively, oil and/or gas wells at deep and moderate deep water comprises an intermediate station in the form of a buoyancy based hollow body (16) tension strut anchored at the seabed (10) and located at a depth substantially closer to the surface of the sea than the seabed (10). At least one hydrocarbon conveying pipeline extends between the buoyancy body (16) and seabed depth, for the transfer of hydrocarbons from the reservoir to said buoyancy body (16). At least one casing extension pipe string **(18*a*–18*h*) constitutes the tension leg/strut anchoring the buoyancy body (16)**. The invention also relates to a method for the building of an underwater installation.

4 Claims, 1 Drawing Sheet

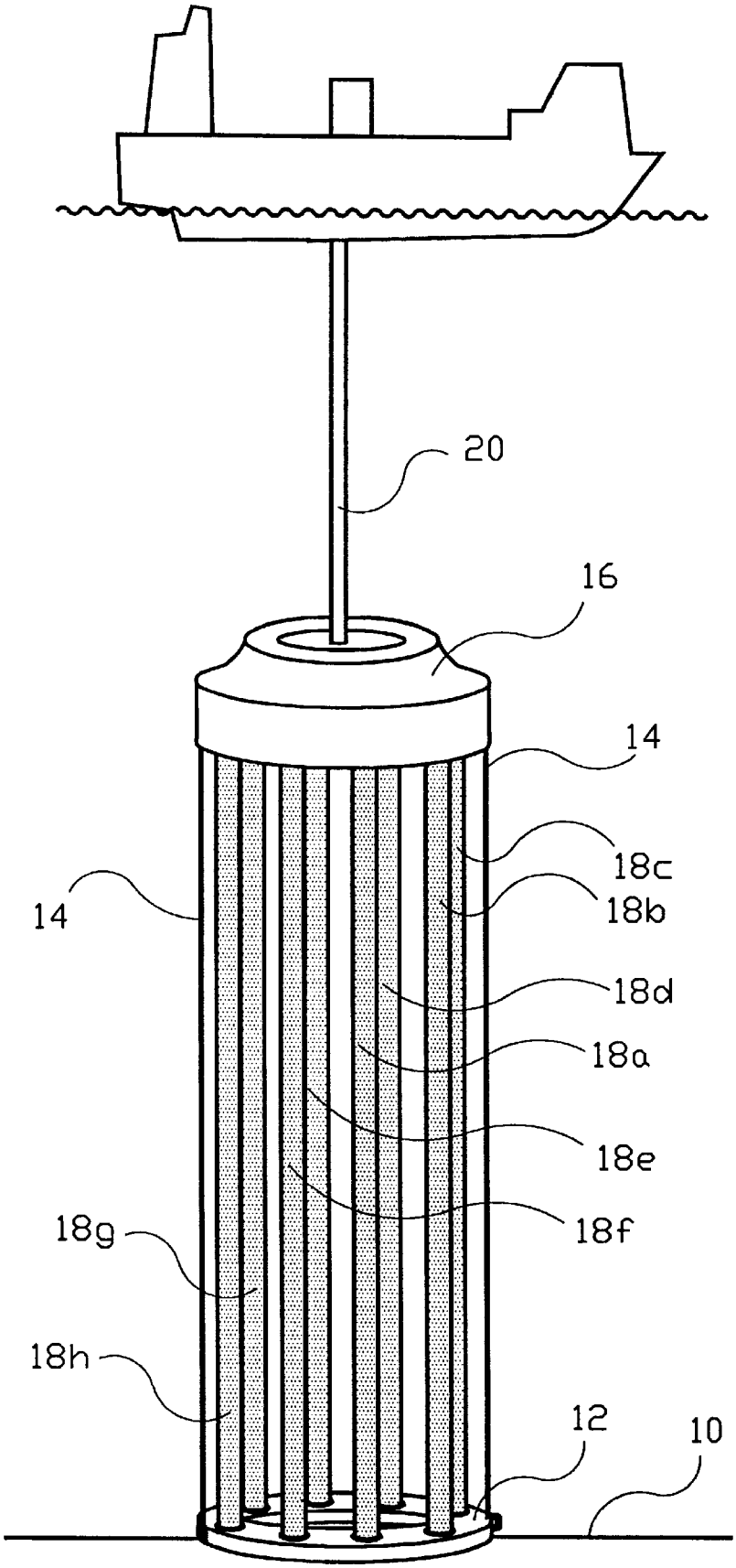
20
16
14
18c
18b
14
18d
18a
18e
18f
18g
18h
12
10

UNDERWATER INSTALLATION AND METHOD FOR BUILDING OF AN UNDERWATER INSTALLATION

BACKGROUND OF THE INVENTION

The invention relates to an underwater installation for use in offshore recovery of oil and gas, particularly at large depths of the ocean.

Oil drilling from floating vessels is a well established technique which can be carried out even at large depths of the ocean. Conventionally, production of oil and gas has taken place by means of fixed installation resting on the seabed. It is difficult to build fixed installations at large depths. Therefore, technique has been developed wherein wellhead and valves belonging thereto are placed on the seabed, and where risers carry hydrocarbons to a vessel at the surface.

Seabed based equipment is to a high degree remote controlled and adapted to the use of a remote control vehicle (a RCV or a ROV) for maintenance, etc. This prior art technique can be used at moderate depths. Using known technique, large depths are difficult to access, and a finished installation will be very expensive.

From Norwegian patent application No. 924962, it is previously known to dispose wellheads on a submerged buoyancy body, from where conductor pipes extend downwardly to wells on the seabed. From the wellhead, hydrocarbons are conducted upwardly to a vessel as previously known. Thus, the buoyancy body serves as an artificial seabed, wherein well completion and production are carried out using prior art technique. If the artificial seabed has a sufficient buoyancy, it may in itself carry a common fixed oil installation.

According to this technique, production wells are drilled in two phases. By means of a floating vessel, a well is drilled to a part of the planned length, e.g. until a 13⅜ inches casing is set, whereafter the well is plugged and left. Thereafter, neighbour wells are drilled in the same manner. The last set casings are, at the upper ends thereof, provided with fasteners in order to be extendable upwardly, e.g. in the form of internal or external threads, to be screwed together with another pipe.

A submerged buoyancy body is anchored above the well area and conductor pipes extend from the buoyancy body and downwardly to the wells, where the conductor pipes are attached to the last set casings. The buoyancy body is positioned at a depth so deep that the wave influence becomes insignificant, the body being attached to the seabed by means of tension struts, such as known from floating tension leg platforms.

On the top of the conductor pipe, within the buoyancy body, a blowout valve is mounted as previously known, risers extending upwardly to a drilling vessel. Drilling of the wells may, thus, continue by means of prior art technique, but now from a substantially less depth than the first phase of the drilling, e.g. one hundred and fifty meters. Second drilling phase which is introduced by drilling out the plug set in the first phase may, thus, be carried out by means of simpler equipment than during the first phase.

Finished drilled wells are completed and put in production as previously known.

Use of a submerged buoyancy body forming an artificial seabed makes it possible to recover oil and gas from substantial depths of the ocean. However, the state of the art, such as represented by said NO 924962, falls unnecessarily expensive, substantially due to a very expensive anchoring.

SUMMARY OF THE INVENTION

The object of the invention is to provide a reasonable anchoring of submerged buoyancy bodies of the kind serving as bases for wellheads to wells at larger depths of the ocean.

The object is achieved through features as defined in the following claims.

The characteristic features of the invention consist in that the buoyance body is anchored to the seabed by means of conductor pipes extending between one of the casings of the well and the buoyancy body.

BRIEF DESCRIPTION OF THE SEVERAL VIEWS OF THE DRAWING

An example of a diagrammatically shown embodiment of the invention is shown in a perspective view when an underwater installation occupies a production phase.

DETAILED DESCRIPTION OF THE INVENTION

On the seabed 10, a subsea frame 12 has been installed in an introduction phase, forming an anchor for lines 14 for submerging and lateral positioning of a buoyancy based hollow body 16.

The underwater installation according to the invention is suitable for use at large depths of the ocean, e.g. 400–4000 meters, and the submerged buoyancy body 16 may e.g. be placed at a depth of e.g. 150 meters, where the influence from the waves is very small, causing a moderate variation in the load on tension struts for the anchoring of the buoyancy body 16 on the seabed.

After e.g. eight wells are predrilled to 13⅜ inches, casing extension pipe strings 18*a*, 18*b*, 18*c*, 18*d*, 18*e*, 18*f*, 18*g*, 18*h* are lowered from a floating platform (not shown) to be screwed to the upper threaded end of last set casings, during which the extension pipe strings 18*a*–18*h* pass through vertically aligned passages, not shown, in the buoyancy body 16. In the production phase, the buoyancy body 16 is closed uppermost, except for a central opening for a production hose 20. After having been screwed to said upper end of last set casings, these casing extension pipe strings 18*a*–18*h*, the number of which corresponds to the number of wells, are attached to the buoyancy body 16 with the upper end thereof. During this attachment, the temporary anchor lines 14 may be tightened for being, thereafter, slackened, transferring the tension strain to "the tension struts" 18*a*–18*h* according to the invention which, thus, are tensioned and tightened.

The temporary anchor lines 14 may be removed when the underwater installation is ready for production.

As mentioned, one or more casing-extension pipe strings 18*a*–18*h* have a double function, namely as a casing and a tension strut. In the embodiment shown, the wells upon completion are considered as being continuous from the reservoir up to the buoyancy based, tension leg/strut anchored, submerged hollow body which is positioned at a depth of another order than the seabed. The invention represents large simplifications in relation to known and conventional technique, and enables the utilization of already established technology such as operations associated to drilling at very large depths of the ocean as well as so-called floating production.

What is claimed is:

1. An underwater installation for offshore drilling of a hydrocarbon well or wells in the seabed in deep and moderately deep water for the production of hydrocarbons from a reservoir below the seabed, the well or wells having an exposed casing or casings on the seabed, said installation comprising an intermediate station in the form of a buoyancy based hollow body, said body being totally submerged below the surface of the water and above the seabed at a depth at which the influence from waves is small, said hollow body being positioned over the well or wells;

a tension leg anchoring means for anchoring the hollow body to the seabed over the well or wells, said anchoring means comprising at least one hydrocarbon conveying pipeline formed of a casing extension pipe string extending between, and being coupled to, the exposed casing or casings of the well or wells on the seabed and the hollow body for forming a tension leg anchoring means for the hollow body and for transferring hydrocarbons from the reservoir in the seabed to the hollow body, said tensioning leg anchoring means forming the sole means for anchoring said submerged hollow body to the seabed; and means for supplying hydrocarbons from the hollow body to the surface of the water.

2. An underwater installation according to claim 1 further including a frame on the seabed for the exposed casing or casings of the well or wells.

3. A method for constructing an underwater installation for offshore drilling of a hydrocarbon well or wells in deep and moderately deep water for the production of hydrocarbons from a reservoir below the seabed, the installation having a totally submerged, intermediate station in the form of a bouyance based hollow body with an upwardly extending production hose for said hollow body for the transfer of said hydrocarbons to a surface of the water, said method comprising the steps of:

a) using a seabed frame, drilling one or more wells in the seabed to leave an exposed casing at the well or wells and thereafter temporarily plugging the well or wells;

b) submerging the hollow body beneath the surface of the water and above the seabed to a depth at which the influence from waves is small;

c) positioning the hollow body over the well or wells d) retaining the body over the wells by means of guys attached to the frame on the seabed and the hollow body;

e) forming a hydrocarbon conveying casing pipe string extension from the exposed casing of one or more wells to the hollow body f) removing the guys to tension the casing pipe string extension so that the casing becomes a tension leg forming the sole means for anchoring the submerged hollow body to the seabed; and g) removing the plugging of the well or wells to supply hydrocarbons to the casing pipe string extension.

4. A method as set forth in claim 3, including the steps of providing a fastener in the form of threads on the exposed end or ends of the casing or casings and connecting said end portion to an adjacent end of a pipe comprising the casing pipe string extension, the opposite end of said pipe being anchored to the hollow body.

* * * * *